US005263623A

United States Patent [19]

Bracken

[11] Patent Number: 5,263,623

[45] Date of Patent: Nov. 23, 1993

[54] TENSIONING APPARATUS FOR A WEB THREADING ENDLESS ROPE

[75] Inventor: Kenneth L. Bracken, Franklin, Ohio

[73] Assignee: Wespatt, Inc., Springfield, Ohio

[21] Appl. No.: 783,425

[22] Filed: Oct. 28, 1991

[51] Int. Cl.[5] ..... B65H 59/38

[52] U.S. Cl. ..... 226/92; 226/118; 226/195; 474/104

[58] Field of Search ..... 226/91, 92, 44, 25, 226/195, 118, 119; 474/109, 110, 136, 137

[56] References Cited

U.S. PATENT DOCUMENTS

| | | | |
|---|---|---|---|
| 3,175,444 | 3/1965 | Spinney | 226/119 X |
| 3,414,208 | 12/1968 | Butler, Jr. et al. | 226/119 X |
| 3,501,075 | 3/1970 | Scharf | 226/25 |
| 3,540,642 | 11/1970 | Riegel | 226/195 X |
| 3,643,497 | 2/1972 | LeCompte | 226/195 X |
| 4,049,168 | 9/1977 | Cole et al. | 226/44 X |
| 4,186,861 | 2/1980 | Steinhilber | 226/118 |
| 4,288,014 | 9/1981 | Evers | 226/44 |

OTHER PUBLICATIONS

Catalog Sheets of Wespatt® Rope Stretcher, Feb. 1992.

Kenbest Pneumatic Tensioner by William Kenyon & Sons, Inc.-approximately 1990.

*Primary Examiner*—Daniel P. Stodola
*Assistant Examiner*—Paul Bowen
*Attorney, Agent, or Firm*—Jacox & Meckstroth

[57] ABSTRACT

A compact rope stretcher maintains the tension in an endless rope used for threading a web in a papermaking machine and includes an elongated H-beam having a flange engaged by guide wheels supporting a pair of separate carriages. The carriages support corresponding rope sheaves for free rotation, and a pair of fluid cylinders are mounted on opposite sides of the beam web and have piston rods connected directly to the corresponding carriages by laterally floating links. Proximity sensors are mounted on opposite end portions of the H-beam for indicating when the rope stretch is reaching a limit, and the beam supports a full length cover which encloses and protects the carriages and cylinders.

12 Claims, 1 Drawing Sheet

TENSIONING APPARATUS FOR A WEB THREADING ENDLESS ROPE

BACKGROUND OF THE INVENTION

In machines for producing a web of paper or paper board, it is common to direct an endless rope or a pair of endless ropes around the end portions of a series of rolls, such as the rolls of the dryer section or a set of calendar rolls, for gripping and threading through the rolls the leading end portion of a web, usually referred to as a "tail". When a single rope is used, it is directed twice around the rolls so that two adjacent ropes extend through the rolls and are effective to pinch the tail and thread it around the rolls. The rope may have a diameter of about one half inch and is usually made of spun nylon filaments or of natural fibers. The rope stretches over a period of use, especially when the rope is driven at a higher speed, for example, over several thousand feet per minute. The ropes can stretch from 7% to 10% within a few days or within a few months depending upon the speed of the papermaking machinery. In the dryer section, the length of the endless rope is frequently between 200 feet and 400 feet so that a 7% to 10% stretch requires substantial take up in the rope in order to maintain the desired rope tension.

In prior art rope stretchers, various types of elongated frames have been fabricated from metal rods and bars of various shapes, and the fabricated steel frames support movable carriages. Flexible cables extend from the carriages around corresponding stationary guide pulleys and also around movable pulleys supported by the extendable piston rods of fluid cylinders. In such a rope stretcher, it is desirable to simplify its construction and to reduce the number of moving parts so that servicing is minimized or substantially eliminated thereby avoiding down time of the papermaking machine in the event the rope stretcher is not properly serviced. It is also desirable to maintain constant tension in the rope to provide dependable and efficient threading of a web tail and to obtain maximum service life from the rope. In addition, it is highly desirable to provide a more compact rope stretcher having a lighter weight and greater strength as well as a rope stretcher which may be installed in any position on papermaking machinery.

SUMMARY OF THE INVENTION

The present invention is directed to an improved rope stretcher which provides all of the desirable features and advantages mentioned above, and which is especially simple, economical and dependable in construction. The rope stretcher of the invention further eliminates the need to fabricate an elongated track and the use of cable and pulley systems, and may be easily constructed in various sizes and lengths depending on the length and stretch of the rope and the desired tension in the rope.

In accordance with one embodiment of a rope stretcher constructed in accordance with the invention, an elongated precision track is formed by an H-beam having parallel flanges integrally connected by a center web. Opposite end portions of the beam are supported by mounting brackets, and one of the flanges supports a pair of adjacent parallel carriage plates by a set of sealed anti-friction guide wheels which positively engage opposite longitudinal edge portions of the flange. Each of the carriage plates supports a rope sheave for free rotation by a sealed anti-friction bearing and is directly connected by a link member to the end portion of a piston rod projecting from a corresponding elongated fluid or air cylinder mounted on the web of the beam. A pair of proximity sensors are mounted on opposite end portions of the beam to detect the presence of the carriages and actuate a signal or alarm when the stretch in the rope is approaching a limit. A longitudinally extending cover extends over the beam and carriages to protect the carriages and fluid cylinders.

Other features and advantages of the invention will be apparent from the following description, the accompanying drawing and the appended claims.

DESCRIPTION OF THE PREFERRED EMBODIMENTS

Figure 1:
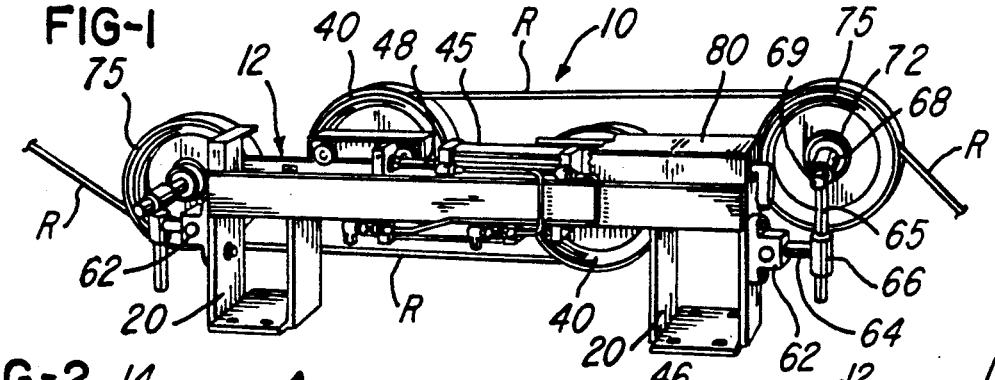
FIG. 1 is a perspective view of a rope stretcher or tensioning apparatus constructed in accordance with the invention and with a portion of a cover guard broken away to show internal assembly.

FIG. 1 illustrates a rope tensioning apparatus or rope stretcher 10 constructed in accordance with the invention and through which extends an endless rope R which may have a diameter of about one half inch and may be constructed of spun nylon filaments or natural fibers. As used herein, the term "rope" includes any flexible endless element which is used to grip the tail of a web of material for threading the web through a series of processing rolls.

The rope stretcher 10 includes an elongated frame 12 (FIG. 4) formed by a steel H-beam having a pair of parallel flanges 14 integrally connected by a web 16. The size of the H-beam frame 12 is selected according to the length and expected stretch of the rope R and the desired tension within the rope. For example, the flanges 14 may have a width portions 18 which are supported by corresponding U-shaped mounting brackets 20 preferably welded to the end portions of the beam.

Figure 2:
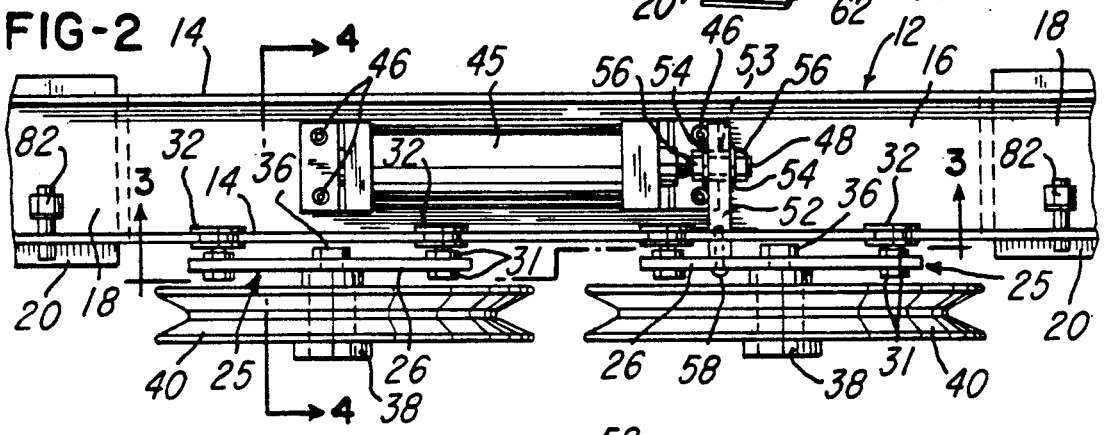
FIG. 2 is a fragmentary plan view of the apparatus shown in FIG. 1.
Figure 3:
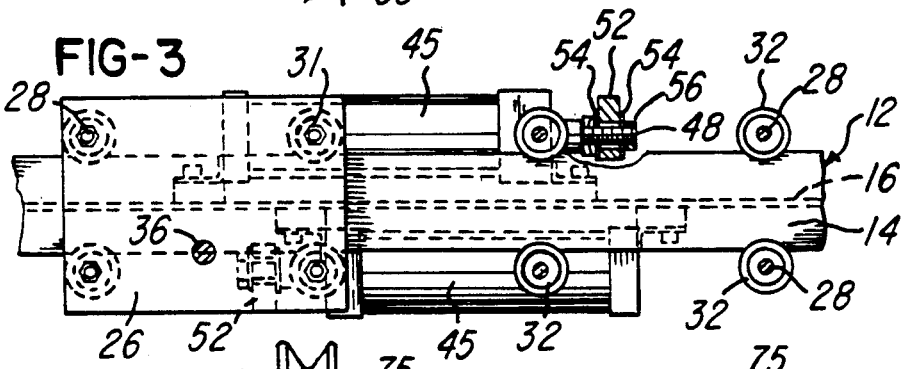
FIG. 3 is a fragmentary section taken generally on the line 3—3 of FIG. 2.
Figure 4:
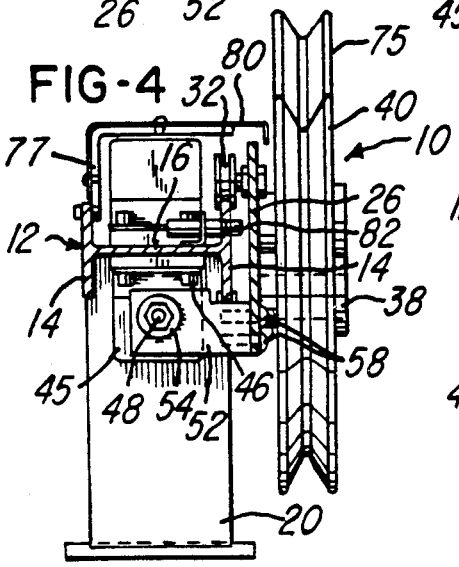
FIG. 4 is a section taken generally on the line 4—4 of FIG. 2.

As shown in FIGS. 2–4, a pair of carriages 25 are supported for smooth longitudinal movement by one of the flanges 14 of the beam 12, and each carriage 25 includes a rectangular carriage plate 26 having a width greater than the width of the adjacent parallel flange 14. A set of four stainless shafts 28 are secured to the corner portions of each of the carriage plates 26 by a set of threaded nuts 31, and each shaft 28 supports a stainless steel spool-like guide wheel 32 having a sealed anti-friction bearing mounted on the shaft 28. The guide wheels 32 on each carriage plate 26 are constructed to engage closely the opposite longitudinally extending edge portions of the adjacent beam flange 14 and support the carriage plate 26 for smooth and precision linear movement along the length of the beam 12. A locking nut 36 is located on the inner side of each carriage plate 26 and is threaded onto the end portion of a shaft 38 which supports a rope sheave 40 having a sealed anti-friction center bearing mounted on the shaft 38 to provide free rotation of the sheave 40.

An elongated fluid or air cylinder 45 is mounted on the web portion 16 of the H-beam 12 for each of the carriages 25, with the cylinders 45 located on opposite sides of the web 16. Each of the cylinders 45 is secured by a set of screws 46 and includes a piston rod 48 having a threaded outer end portion. A laterally projecting link member 52 has a bore 53 which receives the outer end portion of the rod 48, and the bore 53 is somewhat larger than the diameter of the rod 48. A pair of flat washers 54 and corresponding nuts 56 retain the link member 52 on the rod 48 adjacent a pair of opposing cup-shaped spring washers which permit the link member 52 to float laterally by a slight amount relative to the rod 48 to avoid any lateral stress on the piston rod. A pair of screws 58 rigidly secure each of the link members 52 to the corresponding carriage plate 26 so that axial movement of the piston rod 48 of each cylinder 45 is effective to move the corresponding carriage 25 and sheave 40 longitudinally of the track formed by the supporting beam flange 14. The cylinders 45 are connected to air supply lines (not shown) which extend from an electronic control system (not shown) which is adjusted to control the pressure of the air supply to the cylinders 45. The air pressure behind the piston rods 48 normally urges the rods 48 outwardly for urging the carriages 25 longitudinally towards the opposite corresponding end portions 18 of the H-beam 12.

As shown in FIG. 1, a block 62 is mounted on the outer end of each beam support bracket 20 and supports a rod 64 to which is secured a cylindrical bushing 66. Another rod 65 is adjustably supported by the bushing 66 and is secured to another bushing 68. The bushing 68 supports an axially adjustable shaft 69 on which is mounted an anti-friction bearing 72 supporting a freely rotatable rope guide sheave 75. As also shown in FIG. 1, the endless rope R extends under one of the end guide sheaves 75 and more than 180° around each of the carriage supported sheaves 40 and then over the other guide sheave 75 at the opposite or right end of the rope stretcher 10. The rope R then extends around the end portions of the rolls (not shown) of the papermaking or web processing machine. Referring to FIG. 4, a series of longitudinally spaced angle brackets 77 are secured to the other flange 14 of the H-beam 12 and support a right angle sheet metal cover guard 80 which extends the full length of the beam 12.

Figure 5:
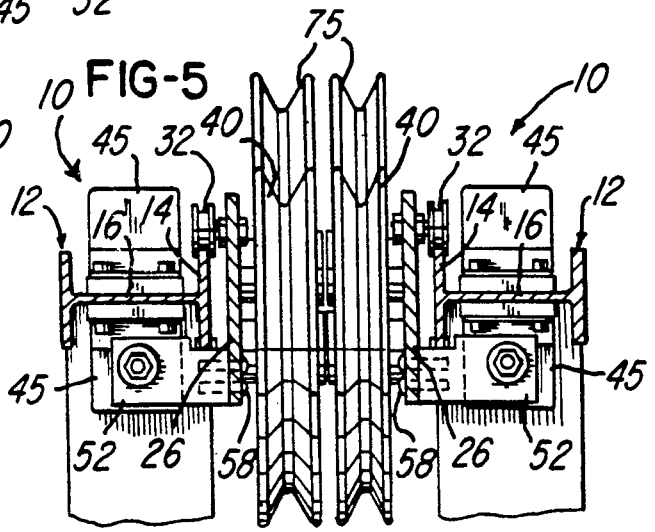
FIG. 5 is a section similar to FIG. 4 of dual tensioning apparatus constructed in accordance with a modification of the invention.

Referring to FIG. 5, a pair of the rope stretchers 10 described above in connection with FIGS. 1–4 are arranged in adjacent relation to form a double rope stretcher for handling a pair of endless ropes. Preferably, when two of the rope stretchers 10 are used, they are arranged so that the sheaves 40 define adjacent parallel paths with the sheaves positioned in closely spaced opposing relation. The end support brackets 20 for each H-beam frame 12 are rigidly secured together by welding a connecting bottom plate (not shown).

As shown in FIG. 2, when air supplied to the cylinder 45 at a predetermined pressure, the outward forces on the piston rods 48 tend to separate the sheaves 40 and maintain a predetermined tension within the rope R according to the selected pressure within the cylinders 45. In order to detect the extent of stretch within the rope R as compensated for by the outwardly movable carriages 25, a pair of electronic proximity sensors 82 are supported by the opposite end portions 18 of the H-beam 12 directly above the mounting brackets 20. Each of the sensors 82 detects when the corresponding carriage 25 is within a predetermined distance, for example, about ten inches. When one of the sensors 82 is activated, it closes an electrical circuit to activate a flashing light or an audible alarm for indicating that the maximum allowable stretch within the rope R is approaching.

From the drawing and the above description, it is apparent that a rope tensioning apparatus or stretcher constructed in accordance with the present invention, provides desirable features and advantages. For example, the construction of the rope stretcher 10 substantially reduces the number of moving parts by having a direct connection between each of the carriage plates 26 and its corresponding piston rod 48 by means of the corresponding link member 52. In addition, the H-beam frame 12 substantially simplifies the construction of the frame while providing for a precision linear track for the carriages 25. Also, the sealed stainless steel anti-friction guide wheels 32 provide for free movement of the carriages 25 so that a precision tension may be maintained within the rope at all times. As a result, the rope stretcher 10, including the beam 12 and carriages 25 operated directly by the cylinders 45, provides for a dependable service life over an extended period of time and requires substantially no maintenance. Thus the rope stretcher is always available during start up of the papermaking machine and after a web break.

The electronic sensors 82 also provide a warning when the carriages 25 are nearing the end of their strokes to alert the operator that it is time to schedule a rope change. This helps to prevent rope breakage or loose ropes which can jump off the tensioning sheaves. The rope stretcher 10 may also be mounted in any position, for example, in a vertical or horizontal or inclined or suspended position while providing the same high reliability and efficiency. The use of a commercially available H-beam to form the frame 12 also permits convenient selection of precision frames of different sizes and lengths, depending upon the number of ropes, the expected stretch in each rope and the desired tension within the rope. For example, an H-beam with a wider web is selected if it is desired to use both flanges 14 for supporting corresponding pairs of carriages 25. The cylinders 45 are then mounted on the web in side-by-side relation. The H-beam frame 12 and the carriages 25 also cooperate to provide for a more compact and lighter weight rope stretcher which results in easier installation of the rope stretcher or multiple rope stretchers for use with two or three ropes. The continuous cover guard 80 also protects the beam frame 12, carriages 25 and cylinders 45 from being exposed to undesirable materials such as caustic liquids or "broke" when a web breaks.

While the forms of tensioning apparatus herein described constitute preferred embodiments of the invention, it is to be understood that the invention is not limited to these precise forms of apparatus, and that changes may be made therein without departing from the scope and spirit of the invention as defined in the appended claims.

The invention having thus been described, the following is claimed:

1. Apparatus adapted for tensioning an endless rope used for threading a web in a papermaking machine and for taking up stretch which develops in the rope over a period of use, comprising a frame including an elongated beam having at least one longitudinally extending and substantially flat flange with longitudinally extending opposite edge portions, said beam also including a longitudinally extending web connected to said flange between said edge portions and projecting generally perpendicular to said flange, at least one carriage including a base member disposed adjacent and substantially parallel to said flange, said base member having a width greater than the width of said flange, a set of spaced wheels mounted on said base member outboard of said flange and engaging said longitudinal edge portions of said flange with said flange extending between said wheels to support said carriage for longitudinal movement along said beam, at least one elongated fluid cylinder extending longitudinally of said beam and having a piston rod movable longitudinally of said beam, means for securing said cylinder to said beam, means for connecting said piston rod to said carriage and providing for movement of said carriage along said flange in response to actuation of said cylinder, and a guide sheave supported by said base member for free rotation and positioned to engage the rope.

2. Apparatus as defined in claim 1 wherein said beam comprises an H-beam having a pair of said flanges with center portions integrally connected by said web.

3. Apparatus as defined in claim 1 wherein said base member comprises a generally flat carriage plate.

4. Apparatus as defined in claim 1 wherein said beam comprises an H-beam having a pair of said flanges with center portions integrally connected by said web, and said fluid cylinder is mounted on said web between said flanges to provide a compact assembly.

5. Apparatus as defined in claim 1 wherein said means connecting said piston rod to said carriage comprise a laterally projecting link member secured to said carriage, and means providing for laterally floating movement of said link member relative to said piston rod.

6. Apparatus as defined in claim 1 and including sensor means supported by said beam for sensing the longitudinal position of said carriage on said flange for indicating the extent of stretch in the rope.

7. Apparatus as defined in claim 1 wherein a second said carriage is supported by said flange with another set of said wheels, said second carriage supporting a second sheave for free rotation, a second said fluid cylinder extending longitudinally of said beam on the opposite side of said web from the first said cylinder and having a corresponding said piston rod, and second said means connecting said piston rod of said second fluid cylinder directly to said second carriage.

8. Apparatus adapted for tensioning an endless rope used for threading a web in a papermaking machine and for taking up stretch which develops in the rope over a period of use, comprising a frame including an elongated H-beam having a pair of longitudinally extending and substantially flat parallel flanges each having longitudinally extending opposite edge portions, said beam also including a longitudinally extending web integrally connecting center portions of said flanges between said edge portions and projecting generally perpendicular to said flanges, a set of carriages each including a base member disposed adjacent and substantially parallel to one of said flanges, said base member having a width greater than the width of the adjacent said flange, a set of spaced wheels mounted on said base member of each said carriage outboard of the adjacent said flange and engaging said longitudinal edge portions of the said flange with said flange extending between said wheels to support said carriage for longitudinal movement along said beam, a set of elongated fluid cylinders extending longitudinally of said beam and having corresponding piston rods movable longitudinally of said beam, means for securing said cylinders to said beam, means for connecting said piston rod of each said cylinder to one of said carriages and providing for movement of said carriage along the adjacent said flange in response to actuation of said cylinder, and a guide sheave supported by said base member for free rotation and positioned to engage the rope.

9. Apparatus as defined in claim 8 wherein said base member of each of said carriages comprises a generally flat carriage plate positioned substantially parallel to the adjacent said flange.

10. Apparatus as defined in claim 8 and including means providing for laterally floating movement of each said connecting means for the corresponding said piston rod.

11. Apparatus as defined in claim 8 and including sensor means supported by said beam for sensing the longitudinal position of each said carriage on said flange for indicating the extent of stretch in the rope.

12. Apparatus adapted for tensioning an endless rope used for threading a web in a papermaking machine and for taking up stretch which develops in the rope over a period of use, comprising a pair of frames each including an elongated beam having at least one longitudinally extending and substantially flat flange with longitudinally extending opposite edge portions, each said beam also including a longitudinally extending web connected to the corresponding said flange between said edge portions and projecting generally perpendicular to said flange, at least one carriage for each said frame and including a base member disposed adjacent and substantially parallel to the corresponding said flange, said base member of each said carriage having a width greater than the width of the adjacent said flange, a set of spaced wheels mounted on said base member outboard of said flange and engaging said longitudinal edge portions of said flange with said flange extending between said wheels to support said carriage for longitudinal movement along the corresponding said beam, at least one elongated fluid cylinder extending longitudinally of each said beam and having a piston rod movable longitudinally of said beam, means for securing each said cylinder to the corresponding said beam, means for connecting said piston rod of each said cylinder to the corresponding said carriage and providing for movement of said carriage along the supporting said flange in response to actuation of said cylinder, a guide sheave supported by said base member of each said carriage for free rotation and positioned to engage the rope, and said frames being positioned with said sheaves having adjacent parallel paths.

* * * * *